US005878987A

United States Patent [19]

Hayde

[11] Patent Number: 5,878,987

[45] Date of Patent: Mar. 9, 1999

[54] SYSTEM FOR ADJUSTABLY MOUNTING AN ITEM TO A VERTICAL SURFACE

[76] Inventor: George Shander Hayde, Koempelstrasse 14, 82340 Feldafing, Germany

[21] Appl. No.: 939,651

[22] Filed: Sep. 29, 1997

[51] Int. Cl.[6] ..... A47G 1/24

[52] U.S. Cl. ..... 248/477; 40/757; 248/495

[58] Field of Search ..... 248/496, 495, 248/489, 476, 477; 40/757, 759

[56] References Cited

U.S. PATENT DOCUMENTS

| | | | |
|---|---|---|---|
| 2,522,901 | 9/1950 | Schrager et al. | 248/495 |
| 2,697,572 | 12/1954 | Pfankuch | 248/495 |
| 2,723,096 | 11/1955 | Schartz | 248/495 |
| 2,939,661 | 6/1960 | Waller et al. | 248/495 |
| 3,251,569 | 5/1966 | Rynearson | 248/495 X |
| 4,566,665 | 1/1986 | Rynearson | 248/495 |
| 4,892,284 | 1/1990 | Kelrick | 248/495 X |

*Primary Examiner*—Ramon O. Ramirez
*Attorney, Agent, or Firm*—Kajane McManus

[57] ABSTRACT

The system for adjustably mounting an item to a vertical surface comprises a track and cooperating slide slidably engaged to one another. One of the system structures engages an item to be mounted and the other of the system structures engages the vertical surface. Relative position between the structures may be adjusted and maintained, with the structures being releasably locked together once engaged. Further, if desired, the system may be engaged to an alarm apparatus to alert of tampering with the system.

15 Claims, 3 Drawing Sheets

FIG. 6
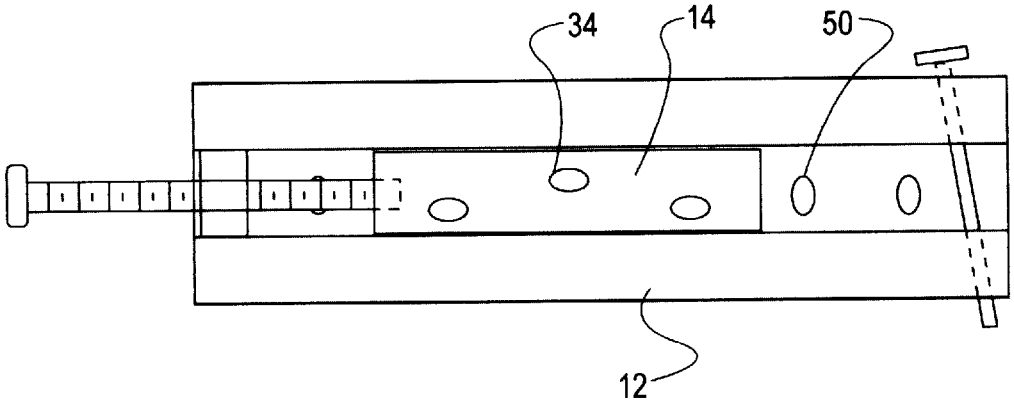
FIG. 7
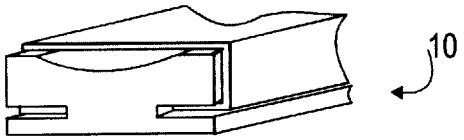
FIG. 8
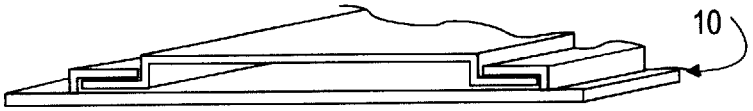
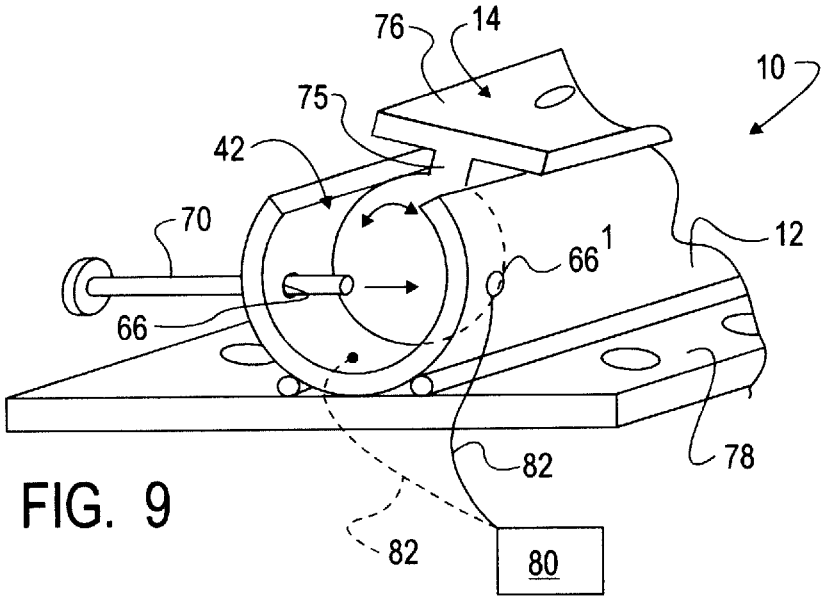
FIG. 9

SYSTEM FOR ADJUSTABLY MOUNTING AN ITEM TO A VERTICAL SURFACE

BACKGROUND OF THE INVENTION

1. Field of the Invention

The present invention relates to a system for adjustably mounting an item to a vertical surface. More particularly, the system comprises a track within which a cooperating slide is adjustably received and locked, with one structure engaging the item and the other structure engaging the vertical surface. Further, if desired, the system will accommodate engagement to a security system to indicate tampering with the mounted item.

2. Prior Art

It is often desirable to mount an item, such as a picture, to a vertical surface, such as a wall. Such mounting often times does not provide exact positioning desired. For example, the item may not hang straight, it may cock when hung by a wire, it may be a bit too high, a bit too low, or it may need to move toward the right or left.

When one uses a hanger such as a nail, numerous holes are made in the wall until desired positioning is attained.

Such disadvantages have been addressed in various ways.

The Schrager et al U.S. Pat. No. 2,522,901 and the Schwartz U.S. Pat. No. 2,723,096 both disclose a vertically adjustable system which incorporates a threaded member for use in adjusting positioning of a hanger engaged thereto while an item remains suspended from the hanger thereof.

The Robertson et al U.S. Pat. No. 4,611,780 discloses a picture hanging assembly which includes adjustable structures for assuring level positioning of an item depending therefrom.

Finally, the Kelrick U.S. Pat. No. 4,892,284 discloses a hanger which is very complex and which accommodates both vertical and horizontal adjustment.

As will be described in greater detail hereinafter, none of the prior art systems discloses structure which not only may be used for assuring desired positioning of an item suspended therefrom but also locks the item onto the vertical surface and accommodates engagement to a security system for indicating tampering with the suspended item.

SUMMARY OF THE INVENTION

The present invention relates to a hanging system for mounting an item to a vertical surface, the system comprising a track and a slide slidably engaged to one another and including structure for maintaining relative position therebetween, the track further engaging one of the vertical surface and the item and the slider further engaging another of the item and the vertical surface.

BRIEF DESCRIPTION OF THE DRAWINGS

FIG. 6 is a front view of the system, showing same oriented for use in a horizontal position.

FIGS. 7–8 show a sampling of configurational embodiments for the system.

FIG. 9 shows a system for accommodating non parallel mounting.

DESCRIPTION OF THE PREFERRED EMBODIMENT

Figure 1:
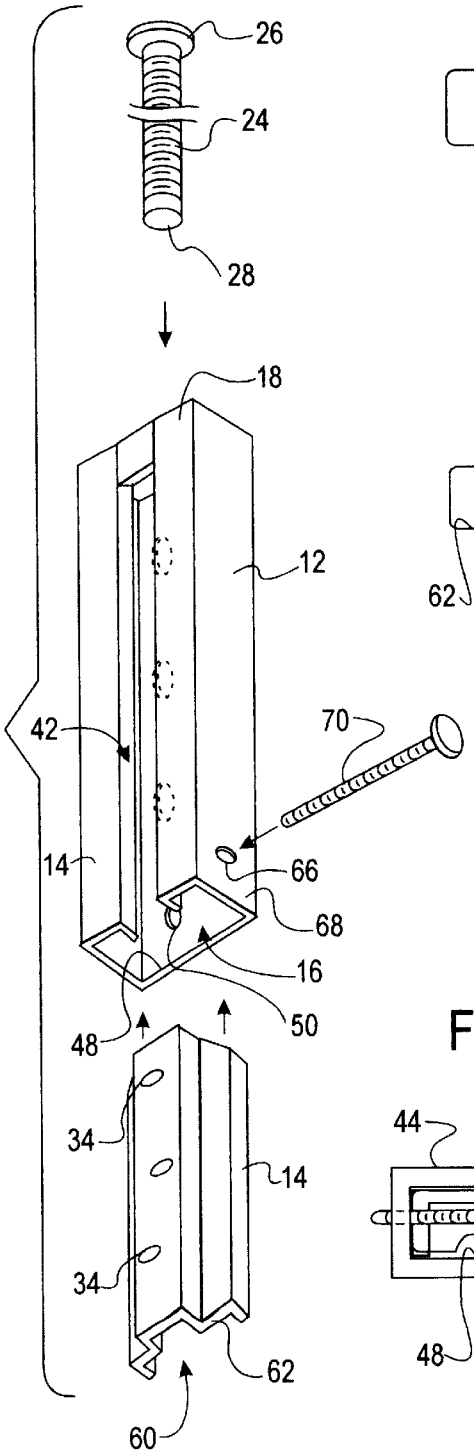
FIG. 1 is a perspective view of the hanging system of the present invention.

Referring now to the drawings in greater detail, there is illustrated therein a system for adjustably mounting an item to a vertical surface made in accordance with the teachings of the present invention and generally identified by the reference numeral 10.

Figure 2:
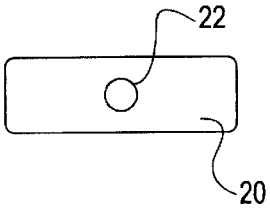
FIG. 2 is an end view of the track of FIG. 1 showing the configuration of a closed end thereof hidden from view in FIG. 1.

As shown, the system 10 includes a base or track 12 within which a slider 14 is received. The track 12 has an open end 16 through which the slider 14 enters the track 12, with an opposite end 18 of the track being closed off by a wall 20 (FIG. 2).

Figure 3:
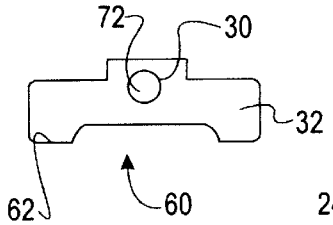
FIG. 3 is an end view of the slider of FIG. 1 showing the configuration a closed end thereof hidden from view in FIG. 1.

Within this wall 20 is a threaded opening 22 which receives a threaded positioning connector or bolt 24, with a head 26 of the connector 24 resting outwardly of the track 12. An opposite end 28 of the threaded connector 24 is rotatably engaged within a nonthreaded slot 30 provided in an end wall 32 (FIG. 3) of the slider 14.

The slider 14 further has a plurality of vertically ovaled throughbores 34 therein, vertically spaced along a length thereof which are provided for use in engaging the slider 14 to a vertical support surface 36 or item 38 to be hung therefrom. The throughbores 34 are ovaled so that a small degree of vertical adjustment for positioning is possible.

It will be understood that the track 12 and slider 14 are configured to slidingly cooperate with each other, with their configuration further being such that the track 12 cannot be disconnected from slider 14 except by sliding the slider 14 out through the open end 16 of the track 12.

It will further be understood that placement of the throughbores 34 in the slider 14 must be located therealong in such a manner that a head 40 (FIG. 4) of a connector or bolt 46 extending inwardly thereof will be accessible for manipulation but will not interfere with cooperating slidability between the track 12 and slider 14 when they are engaged to one another.

To meet this requirement, the track 12 includes a center channel 42 in one surface 44 thereof through which bolt heads 40 may be reached and along which bolts 46 used for mounting the slider 14 may be accommodated while the slider 14 and track 12 are cooperatively engaged.

It will also be seen that another surface 48 of the track 12, which is opposite the surface 44 having the channel 42 therein, is provided with a plurality of horizontally ovaled throughbores 50 therein which lie along a line centered along the length of the surface 48. The throughbores 50 here allow for a small degree of horizontal adjustment in positioning. The throughbores 50 in the track 12 are provided for use in engaging the track 12 to a selected surface such as a rear surface 52 of the item 38, such as a picture frame 38, or a selected vertical surface 36 such as a wall 36.

Figure 4:
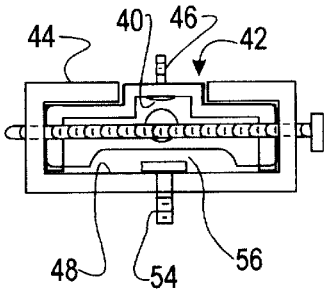
FIG. 4 is an enlarged bottom plan view of the system and shows heads of connectors for engaging the system to an item and a vertical surface in phantom.

To accommodate for track connector head 56 (FIG. 4) placement within the track 12 it is necessary to assure cooperative slidability therepast as well and this is accomplished by providing at least a channel 60 in an underside 62 of the slider 14 which will avoid contact with the connector head 56 within the track 12, maximally providing an essentially three sided, hollow slider 14 as best illustrated in FIG. 4, which is a bottom view showing the slider 14 and track 12 joined together with connector head 40 and 56 placement being illustrated therein.

It will be understood further that it is desirable to be able to simply lock the track 12 and slider 14 together so that the item 38 suspended by the system 10 cannot be easily removed therefrom.

For this purpose, the track 12 is created to be significantly longer than the slider 14, and a throughbore 66 is provided in each sidewall 68 of the track 12. A further threaded connector 70, having a length greater than the width of the track 12 is engaged across the open end 16 of the track 12, by threading same through the pair of throughbores 66, effectively locking the slider 14 within the track 12.

Figure 5:
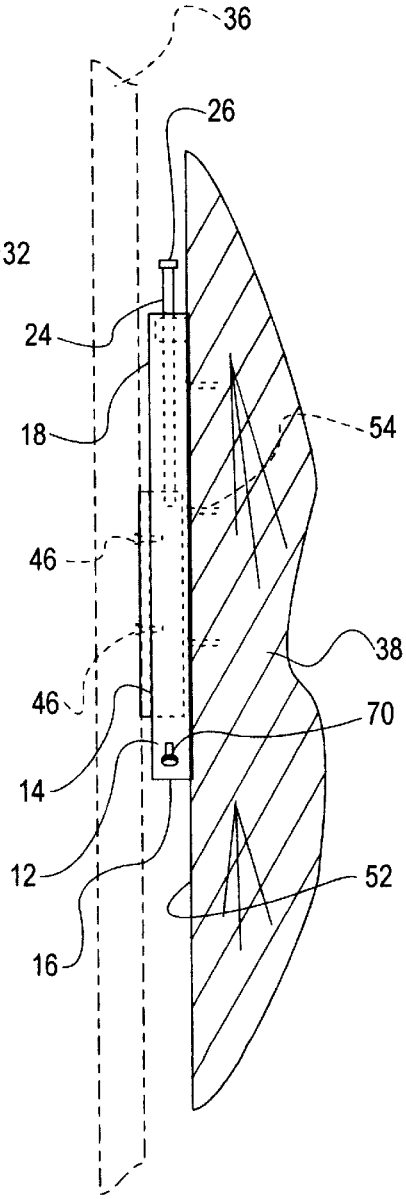
FIG. 5 is a perspective side view of a vertical surface and an item suspended therefrom by the system of FIG. 1.

Engagement and locking of the slider 14 and track 12 together are performed only after the individual elements 12 and 14 are appropriately engaged to their respective structures 36, 38 producing a locked in place vertical mounting of the item 38, as best illustrated in FIG. 5.

Here, the slider 14 is fixed to the vertical support surface or wall 36 by at least one connector 46 and the track 12 is seen engaged to the item 38 or picture frame 38 by at least one connector 54 shown in phantom.

Open end 16 of the track 12 is downwardly disposed and elevation of the opposite end 18 of the track 12 above the top surface 32 of the slider 14 is determined by threaded positioning of the bolt 24 extending through the opening 22 of the track 12 into and against an opposing bottom surface 72 of the slot 30 provided in the surface 32 of the slider 14.

Once desired relative positioning is achieved by manipulation of the bolt 24, engagement is locked by insertion of the locking bolt 70 as described above.

FIG. 6 discloses a horizontal orientation for the system 10 which is desirable for use when adjustability of horizontal rather than vertical orientation is of greater importance.

FIGS. 7 through 9 are provided to illustrate several further embodiments that are possible for the system 10, among others, and that the specific configurations shown and described should not be construed as limiting.

Further with respect to FIG. 9, which discloses a track 12 and slider 14 having a circular incross section configuration, it will be seen that the center channel 42 in the track is wider than necessary. Here the slider 14 includes a narrow portion or neck 75 extending through the channel 42 but only partially thereacross and engages a mounting flange 76 to the slider 14.

It will also be seen that the track 12 also includes a mounting flange 78. Without any connector heads interfering with relative motion between the track 12 and slider 14, it will be understood that relative rotational positioning between the structures, to the limits allowable by the width of the channel 42 relative to the width of the neck 75 is provided in this embodiment.

Such relative rotational positioning would come into play when a certain tolerable degree of nonparallelism or angulstion between the vertical surface 36 and the item 38 were to be dealt with. For instance, it is not uncommon to find a picture frame 38 which is warped due to longevity, etc. Further walls 36 are not necessarily truly planar. Thus such nonparallelism could be accommodated within rotational limits set by channel 42. It will be understood, of course, that the channel 42 at some point could be proposed which would be so wide as to allow for disengagement between the track 12 and slider 14 therethrough, an unworkable configuration. Thus channel 42 width is limited to a distance where assured engagement between the track 12 and slider 14 is not compromised.

Figure 10:
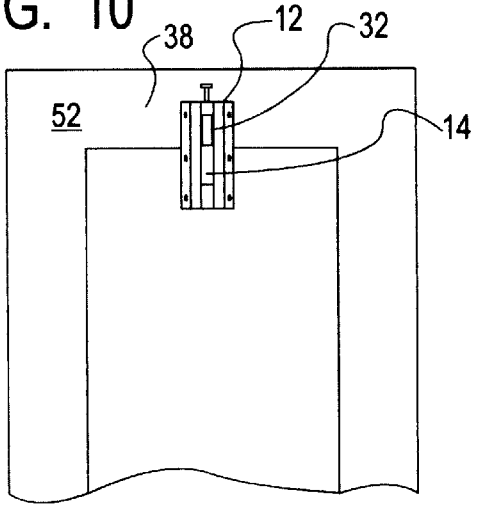
FIG. 10 shows an item having a single track attached thereto.
Figure 11:
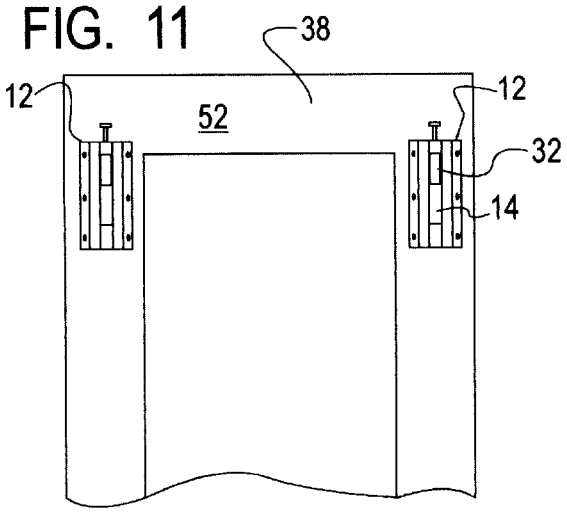
FIG. 11 shows an item having 2 tracks attached thereto.

FIGS. 10 and 11 show an item 38 engaged to one or more tracks 12 and ready to be mounted to a vertical surface 36 by a cooperating one, or plurality of, sliders 14 having end wall 32 thereof upwardly directed.

Figure 12:
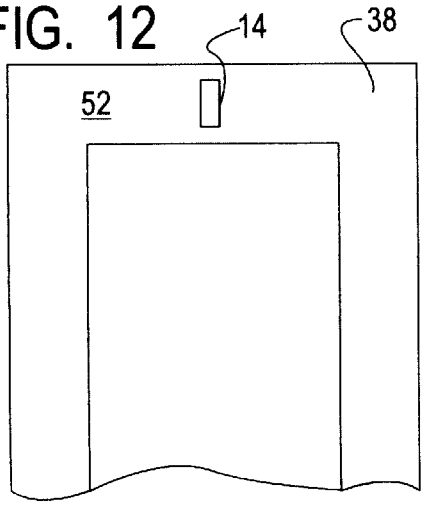
FIG. 12 shows an item having a slider attached thereto.
Figure 13:
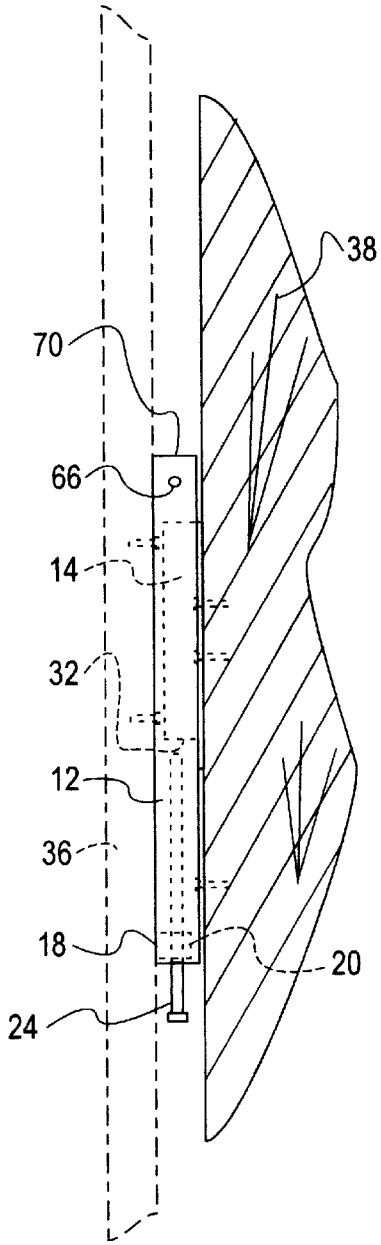
FIG. 13 shows attachment of the item of FIG. 13 to a track mounted to a vertical surface.

FIGS. 12 and 13 disclose a vertical orientation for at least one system 10 wherein a slider 14 is engaged to the item 38 to be mounted, necessitating engagement of the track 12 to the supporting surface 36. Here it will be seen that the track 12 is inverted from the position of FIG. 5. This places the end 18 of the track 12, through the wall 20 of which the positioning bolt 24 extends, downwardly disposed. For the bolt 24 to act upon the end wall 32 of the slider 14, the slider 14 must be engaged to the item 38 in a manner where the wall 32 is also downwardly disposed. Such opposite orientation to that illustrated for use when the slider 14 is engaged to the vertical surface 36 is necessary so that relative adjustability is provided and places the locking bolt 70 above the slider 14.

It will be understood that use of the system 10 in the horizontally adjustable position would be without such concern because horizontal placement of the track 12 and slider 14 would eliminate concern about gravitational effects possibly pulling the structures apart or compromising relative adjustability.

Still further, it will be understood that the system 10 easily accommodates engagement to alarm apparatus 80 as best illustrated, in its most simplistic form, in FIG. 9. Here, one common point is seen to be one of the throughbores 66 in the track 12 through which the locking connector 70 passes last when being engaged. Thus, if the connector 70 were being disengaged, it would first move out of contact with the last engaged throughbore 66.

To create an immediate awareness of attempted disengagement between structures of the system 10 one could engage the alarm apparatus as schematically represented by the box 80, via a conductor 82 to the throughbore 66, in known manner such that, when the connector 70 is disengaged from the throughbore 66, it will cause the alarm apparatus 80 to activate, producing an alarm.

Alternatively, the open end 16 of the track 12 defining a noncommon point could be engaged to the alarm apparatus 80 to indicate that the slide 14 was now in contact with the open end 16 as secondarily illustrated in phantom at 82. Thus, it will be understood that various common points could be engaged in known manner to the alarm apparatus 80 to indicate disengagement between various elements of system 10.

As described above, the system 10 provides a number of advantages, some of which have been described above and others which are inherent in the invention. Also, modifications may be proposed without departing from the teachings herein. Accordingly, the scope of the invention is only to be limited as necessitated by the accompanying claims.

I claim:

1. A hanging system for mounting an item to a vertical surface, the system comprising a track and a slide slidably engaged to one another and including means for maintaining relative position therebetween, the track having means for further engaging directly to either of said vertical surface and said item and the slider having means for further engaging either of said item and said vertical surface.

2. The system of claim 1 further including means for releasably locking the track to the slider.

3. The system of claim 2 wherein an alarm apparatus is engaged to at least one point common to at least two the system structures in a manner such that disengagement of one of the structures at the common point causes alarm apparatus activation.

4. The system of claim 2 wherein said track has an open end through which the slider is engaged within said track and said means for releasably locking said track to said slider comprise a threaded connector secured across said open end of said track.

5. The system of claim 2 wherein an alarm apparatus is engaged to at least one noncommon point on the track over which the slider must pass during disengagement in a manner such that contact of the slider with the noncommon point will cause alarm activation.

6. The system of claim 1 wherein said track defines a hollow channel in one surface thereof opposite a surface thereof which is engageable to one of said item and said vertical surface.

7. The system of claim 6 wherein said slide has a first surface which rests along the engageable surface of the track, said surface including at least a channel along a length thereof.

8. The system of claim 7 wherein said slide has another surface which is opposite said first surface and includes structure thereon accessible through said channel in said track for engaging said slide to one of said item and said vertical surface.

9. The system of claim 1 wherein said slide and said track are circular in cross section.

10. The system of claim 9 wherein said track has a wide elongate channel along a length thereof.

11. The system of claim 10 wherein said slide has structure thereon which is engageable to one of said item and said vertical surface.

12. The system of claim 11 wherein said engageable structure of said slide includes a portion which is narrower than said track channel.

13. The system of claim 12 wherein said narrower portion passes through said channel, said narrower portion allowing for a small degree of relative rotation between said track and said slide about a center axis of the system.

14. The system of claim 13 wherein said narrower portion is a neck which engages said slide to a mounting flange exterior of said channel.

15. The system of claim 1 wherein said track has a closed end and said means for maintaining relative position between said track and said slide comprise a threaded member extending through said closed end of said track, said threaded member having a tip which seats within a hole in an end wall of said slide.

* * * * *